US006698417B2

(12) United States Patent
Frasnetti

(10) Patent No.: US 6,698,417 B2
(45) Date of Patent: Mar. 2, 2004

(54) DEVICE FOR OBTAINING RAPID IGNITION OF A COOKING HOB GAS BURNER FED VIA A GAS PIPE PROVIDED WITH A SOLENOID SAFETY VALVE

(75) Inventor: Luca Frasnetti, Cunardo (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/735,213

(22) Filed: Dec. 12, 2000

(65) Prior Publication Data

US 2003/0124475 A1 Jul. 3, 2003

(30) Foreign Application Priority Data

Dec. 16, 1999 (IT) ..... MI99A2606

(51) Int. Cl.[7] ..... F24C 3/00

(52) U.S. Cl. ..... 126/39 N; 126/39 BA; 431/67; 431/73

(58) Field of Search ..... 126/39 N, 39 BA, 126/42, 39 E; 431/73, 67, 45, 43, 75, 66

(56) References Cited

U.S. PATENT DOCUMENTS 3,395,968 A * 8/1968 Mobarry et al. ..... 431/45
4,242,078 A * 12/1980 Nelson et al. ..... 431/45
4,993,401 A * 2/1991 Diekmann et al. ..... 126/39 E
5,300,759 A * 4/1994 Dodson ..... 219/506
5,403,183 A * 4/1995 Andersson et al. ..... 431/74
5,575,638 A * 11/1996 Witham et al. ..... 431/73
5,673,680 A * 10/1997 Kalmer et al. ..... 126/39 B

FOREIGN PATENT DOCUMENTS

FR 2 758 179 A1 * 7/1998 ..... F24C/3/10

* cited by examiner

*Primary Examiner*—Josiah Cocks
(74) *Attorney, Agent, or Firm*—Thomas J. Roth; Robert O. Rice; John F. Colligan

(57) ABSTRACT

A device for obtaining rapid ignition of a gas burner of a cooking hob fed via a gas pipe provided with a solenoid safety valve, with said burner there being associated a usual igniter and a knob for controlling its activation, the solenoid valve being connected to powering means immersed in the flame generated by the burner to maintain the solenoid valve in a working position which ensures gas feed to the burner, further powering means being provided to maintain said solenoid valve in said working position immediately a user activates the burner by means of the knob, without any further action on the knob by said user.

7 Claims, 3 Drawing Sheets

DEVICE FOR OBTAINING RAPID IGNITION OF A COOKING HOB GAS BURNER FED VIA A GAS PIPE PROVIDED WITH A SOLENOID SAFETY VALVE

BACKGROUND OF THE INVENTION

1. Field of the Invention

This invention relates to a device for obtaining rapid ignition of a gas burner of a cooking hob in accordance with the introduction to the main claim.

2. Description of the Related Art

Gas cooking hobs are known to comprise a plurality of burners each fed by its own gas pipe. Each burner is controlled by a corresponding knob and is associated with a known spark generator (or igniter) controlled via the said knob or via an independent pushbutton. The gas pipe can be of valved type or non-valved type. The non-valved type does not comprise any safety member for shutting off the gas flow to the burner. The valved pipe is instead provided with a small solenoid valve in series with the usual valve or cock operated by the knob. If the flame is accidentally extinguished the solenoid valve in series with the cock closes to hence interrupt the escape of unburnt gas from the burner. In this manner a safety function is achieved on the cooking hob.

The operation of this solenoid valve is triggered by a thermocouple or similar member (immersed in the flame) acting as a voltage generator. When the flame is present, the thermocouple generates a voltage sufficient to maintain the solenoid valve open, whereas when the flame disappears the voltage generated falls below the minimum necessary to maintain the solenoid valve open, so causing it to close and interrupt gas flow.

This solution is negatively influenced by the thermal inertia involved in heating the thermocouple. In this respect the voltage generated depends exclusively on the temperature of the thermocouple cold joint. This temperature is itself dependent on the thermal mass of the thermocouple and its housing. On accidental extinguishing, this thermal inertia shows as a delay in closing the solenoid valve after the disappearance of the flame. On ignition, this delay is much more apparent and results in lack of user satisfaction. In this respect, to ignite a burner having a solenoid valve in its feed pipe in which the corresponding knob activates the igniter, the user has to first press (applying a fairly large force) and rotate the knob controlling the gas cock and maintain it pressed for the time required to ignite the flame and then heat the thermmocouple. If the knob is released before the thermocouple attains a temperature sufficient to maintain the solenoid valve in its open position, the flame goes out and the user has to again act in the aforesaid manner to attempt a second ignition.

The situation is further worsened by the fact that on the cooking hob there is nothing to indicate to the user when the thermocouple is sufficiently hot for the knob to be released, so that there is a high probability of its early release with consequent extinguishing of the flame. This means that involuntary extinguishing is one of the causes of widespread user dissatisfaction with currently available cooking hobs.

SUMMARY OF THE INVENTION

An object of the invention is to provide a device for obtaining rapid ignition of a cooking hob burner fed via a gas pipe provided with a solenoid valve or safety valve.

A particular object of the invention is to provide a device of the aforesaid type which enables the safety valve positioned in the gas pipe to be activated immediately on operation of the burner control knob by a user, by nullifying the waiting time for this activation related to the heating of the thermocouple associated with the burner. In this way the user is saved the annoying initial stage in burner activation in which said knob has to be kept pressed, and avoids the possibility of the user releasing the knob before the required time and causing the flame to go out, so that a second ignition has to be attempted.

These and further objects which will be apparent to an expert of the art are attained by a device in accordance with the accompanying claims.

BRIEF DESCRIPTION OF THE DRAWINGS

The invention will be more apparent from the accompanying drawing, which is provided by way of non-limiting example and on which.

DESCRIPTION OF THE PREFERRED EMBODIMENT

Figure 1:
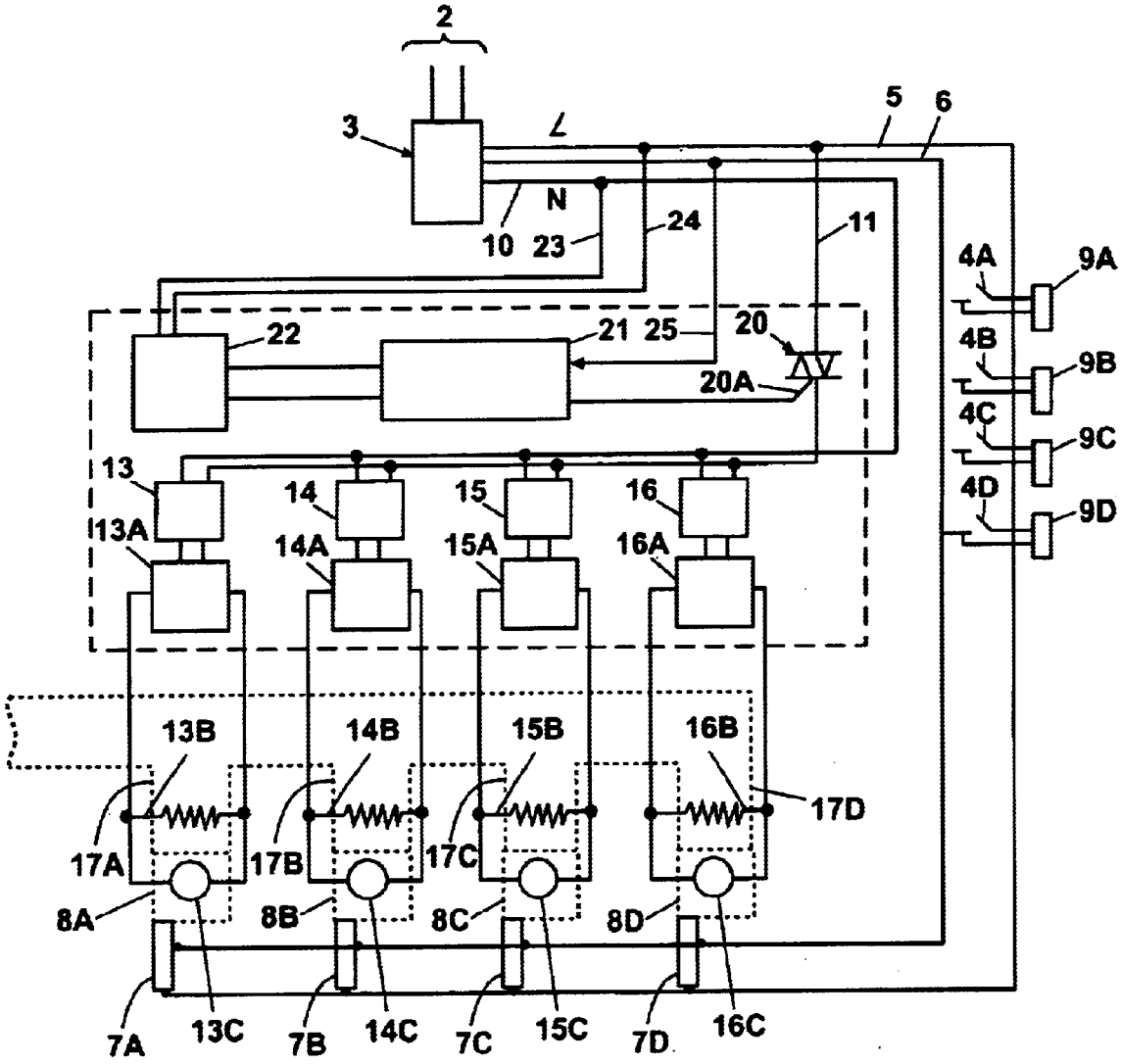
FIG. 1 is a schematic view of a device of the invention.
Figure 2:
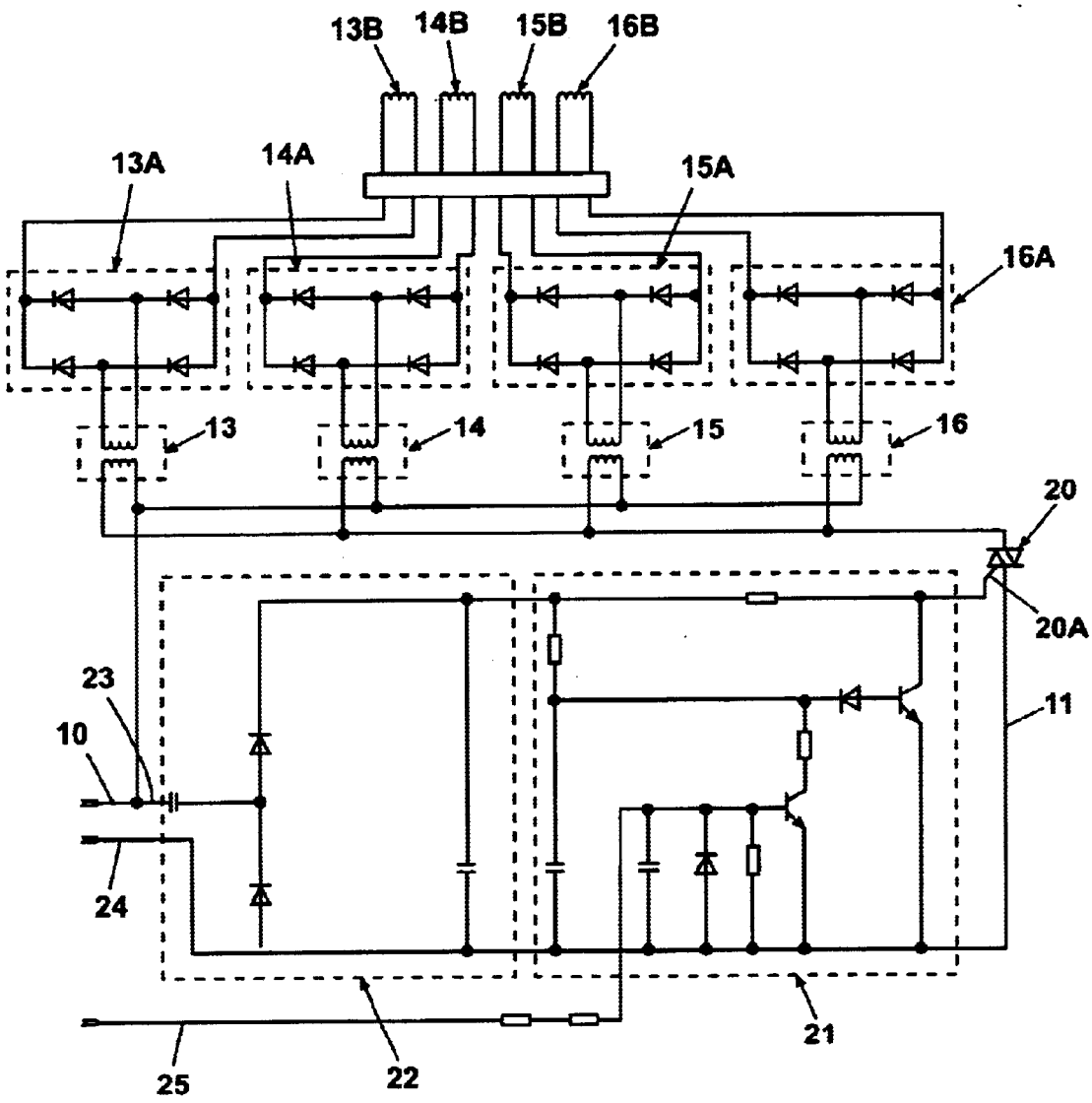
FIG. 2 is an example of a circuit diagram of the device.

With reference to FIGS. 1 and 2, these show (schematically in FIG. 1 and structurally in FIG. 2) a device according to the invention, indicated overall by 1. It is connected into a circuit arrangement comprising a power line 2 connected to an activation block 3 for usual igniters or spark generators 7A, 7B, 7C, 7D associated with a plurality of gas burners 8A, 8B, 8C, 8D controlled in their activation by knobs 9A, 9B, 9C, 9D positioned on the cooking hob. With each of these knobs there is associated a switch 4A, 4B, 4C, 4D connected via electrical lines 5, 6 (feed and return) to the block 3. On closure of any switch by operating a corresponding knob, the block 3 is activated in known manner to activate in known manner (and therefore not described) either all the spark generators or igniters or that particular igniter associated with that burner of which the corresponding knob has been operated, depending on the manner in which the cooking hob is formed.

From the block 3 there extends a further electrical line (neutral) 10 which together with the line 11 (phase) connected to the power line 5 provides the supply for a plurality of electrical transformers 13, 14, 15, 16 connected to relative rectifier circuit configurations (for example comprising diode bridges) 13A, 14A, 15A, 16A connected in parallel with corresponding solenoid valves 13B, 14B, 15B, 16B positioned in gas feed pipes 17A, 17B, 17C, 17D connected to the burners. In parallel with these solenoid valves there are connected thermocouples 13C, 14C, 15C, 16C "immersed" in the flame of the respective burner when activated.

In the (supply or phase) line 11 there is connected a switch means 20, for example a static switch such as a TRIAC or the like. The switch 20 is connected to and controlled by a timer 21 to which a powering member 22 is connected. The powering member 22 is connected to said lines 5 and 10 by electrical lines 23 and 24. The timer 21 is connected to the return line 6 by a line 25, said line 25 acting as a triggering line for the timer operation.

In this manner, by means of the said timer member (which can be electronic or mechanical) connected in parallel with the igniter activation block 3, a plurality of circuit members (for example diode bridges) can be powered, by which a supplementary electrical feed (taken from the electrical lines 5 and 11 connected to the block 3 powered by a fixed electric mains) can be supplied to the electrical member (winding) of each solenoid valve. In this manner, immediately and simultaneously with the activation of the block 3 (and hence of an igniter), by operating a control knob for a particular burner the solenoid valve positioned in the gas feed pipe connected to that burner will open and remain open until the thermocouple associated with said solenoid valve has heated sufficiently to independently maintain the electrical member of the corresponding solenoid valve powered.

In this respect, it will be assumed that the cooking hob with burners is to be used with the device 1. It will be assumed, for example, that the burner controlled by that knob operating on the switch 4A is to be used. Operating this knob closes the switch 4A, to power the block 3 in known manner, and activate for example the igniter positioned at said burner.

Simultaneously an electrical signal flows along the line 25 towards the timer 21, which becomes active as it is powered by the member 22 connected to the lines 5 and 10, in both of which an electrical signal is present. The timer 21 closes the switch 20 by acting on its gate 20A, so that an electrical signal flows along the line 11 to the transformers 13, 14, 15 and 16. These transformers are hence powered to maintain the corresponding solenoid valves 13B, 14B, 15B and 16B open. As only one knob has been operated (corresponding to the switch 4A), only its corresponding usual valve connected to it (and positioned in the gas pipe directed to the corresponding burner) is opened. As this valve, as is well known, is present upstream of the solenoid valve 13B positioned in the same pipe, the gas in this pipe is able to reach the already open solenoid valve 13B and through it reach the burner. All this occurs substantially immediately after operating said knob.

The timer 21 maintains the switch 20 active and closed for a few seconds, for example between 3 and 10 seconds and preferably between 5 and 7 seconds. During this period the solenoid valve 13B is powered independently of the action of the corresponding thermocouple 13C and is hence maintained open. The thermocouple becomes hot during this period, to be then able independently to power the solenoid valve 13B in known manner when the feed to the solenoid valve 13B via the transformer 13 terminates. At this point, that burner corresponding to the knob connected to the switch 4A can be maintained active in known manner (and without power from the now deactivated transformer 13.)

In a different embodiment, a microprocessor member is interposed between the switches 4A, 4B, 4C, 4D and the block 3. This member (not shown) is connected to the individual transformers and, on a timed basis, powers these and hence the individual solenoid valves (by virtue of its internal circuit of known type), depending on the knob setting and hence on the activated burner. In this manner only one solenoid valve is powered when a single corresponding knob is operated.

Figure 3:
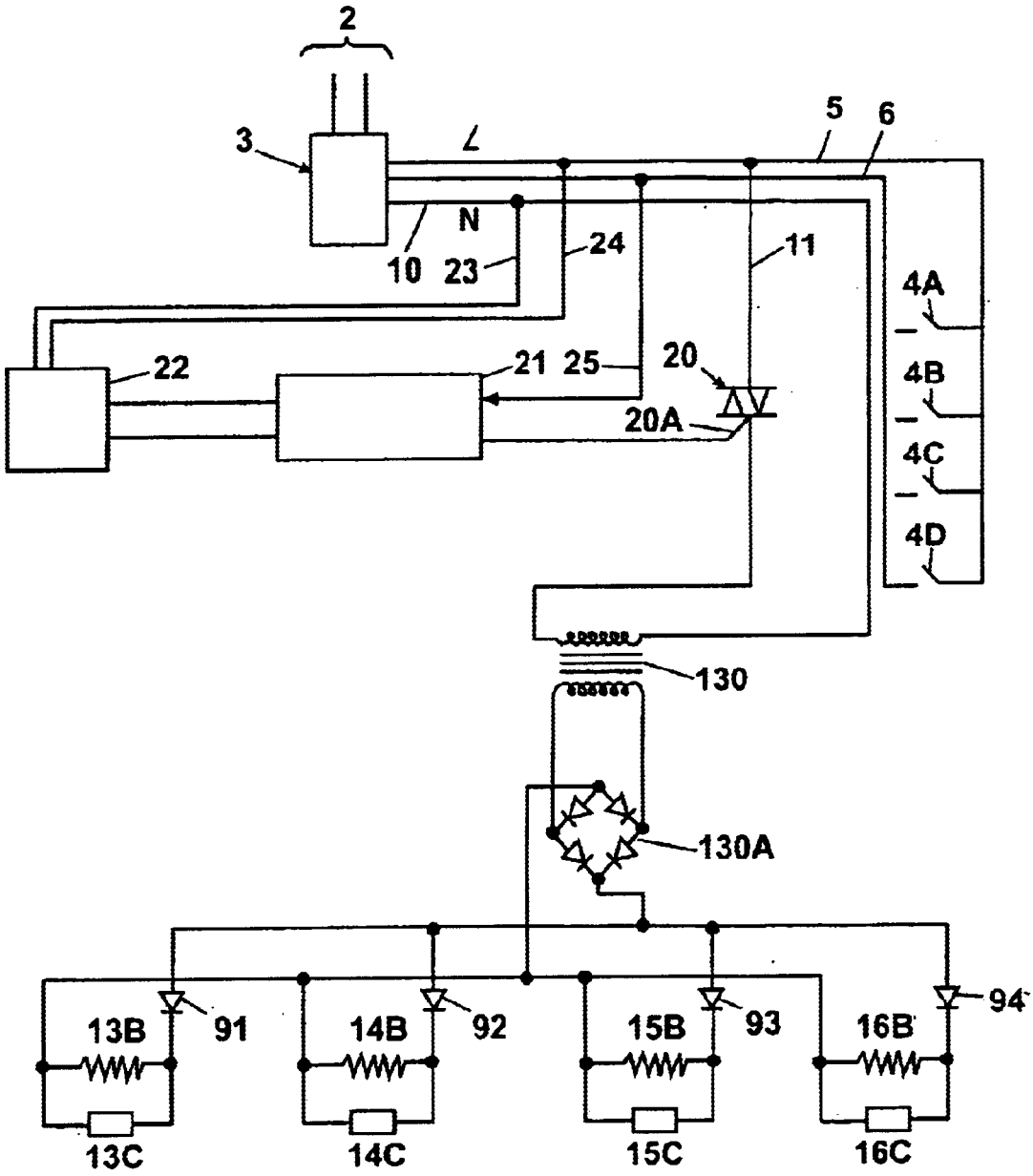
FIG. 3 is a schematic variant of the device of FIG. 1.

FIG. 3 shows a further variant of the invention. In this figure, in which parts corresponding to those already described in relation to FIGS. 1 and 2 are indicated by the same reference numerals, a single transformer 130 is provided powering a single rectifier circuit 130A (diode bridge).

On operating for example the knob 4A in the manner already described with reference to FIGS. 1 and 2, the switch 20 is "closed" by the timer 21 and an electrical signal is able to flow along the line 11 to the transformer 130, and power it. The circuit or diode bridge 130A is hence powered and an electrical signal reaches the solenoid valves 13B, 14B, 15B and 16B, setting them for operation. As only one knob has been operated (that corresponding to the switch 4A), only the corresponding valve connected to it is opened. As this valve is upstream of the solenoid valve 13B positioned in the same gas feed pipe, only the gas present in gas feed pipe can reach the corresponding burner and activate it. As already described in relation to FIGS. 1 and 2, on termination of activation of the transformer 130, the thermocouple 13C maintains the corresponding burner active.

To prevent random activation also of the other solenoid valves not involved by the operation of the said knob, a diode 91, 92, 93, 94 is positioned in the feed lines to the solenoid valves to prevent the current generated by the active thermocouple (for example 13C) from powering the other solenoid valves (for example 14B, 15B, 16B), activation of which is not required.

In a further embodiment, each solenoid valve can be connected to its own timed auxiliary voltage generator or to timed auxiliary powering means possibly connected to the fixed electric mains and activated by switches controlled by the knobs. Operating these knobs activates the auxiliary generating means, to hence power the solenoid valves as already stated.

The invention hence achieves substantial immediacy between the activation of a burner by operating a corresponding knob and the feed of gas to that burner, the gas feed being maintained without having to wait for the usual element (thermocouple) immersed in the burner flame to heat up and generate an electrical supply signal able to keep open the corresponding solenoid valve positioned in the respective gas pipe.

It should be noted that the transformers 13, 14, 15, 16, 130 are provided with a protection fuse in the primary winding, the purpose of which is to interrupt power to the transformers 13, 14, in a position in which they continuously power said transformers.

The invention consequently facilitates use of the cooking hob and prevents the annoying flame extinguishing which occurs in known cooking hobs.

I claim:

1. A cooking appliance including:

at least one gas pipe connected with an external gas supply;

a solenoid safety valve associated with each gas pipe, the solenoid safety valve being configured to control the flow of gas through the gas pipe;

a gas burner interconnected to each gas pipe and supplied with gas via the gas pipe, an igniter and a knob associated with each burner for controlling the activation of the burner, each igniter being in electrical communication with a first power supply, a thermocouple positioned to be being immersed in a flame generated by each burner, a switch in electrical communication with each thermocouple;

a timer in electrical communication with the igniter and the switch; the timer being configured to close the switch for a predetermined period of time for allowing electricity to flow to one or more transformers in electrical communication with the solenoid valves;

a second power supply for supplying power to each of the solenoid valves and timer;

wherein upon operation of one of the knobs for activating one of the burners, power from the first power supply activates the igniter corresponding to the desired burner and simultaneously an electrical signal activates the timer powered by the second power supply, the timer closes the switch for the predetermined period of time which keeps the solenoid valve held in an open position for the predetermined period of time for ensuring gas feed to the burner, thereby ensuring the thermocouple reaches a predetermined temperature due to the flame generated by the burner, which ensures that a user only has to operate the knob a single time.

2. The cooking appliance according to claim 1, wherein the second power supply in electrical communication with at least one electrical transformer connected in parallel with rectifier means connected in parallel with the solenoid valve in the burner gas feed pipe.

3. A cooking appliance as claimed in claim 2, wherein the rectifier means are at least one rectifier circuit configuration comprising a diode bridge.

4. A cooking appliance as claimed in claim 1, wherein each electrical transformer is connected to a corresponding rectifier circuit configuration which is connected in parallel with said solenoid valve.

5. A cooking appliance as claimed in claim 1, wherein the second power supply is inserted into a circuit arrangement comprising the switch connected to the knob corresponding to the burner, the switch being further connected via a feed line and a return line to an ignition control block positioned at said burner, an electrical line containing switch means being connected to the feed line and being directed to the second power supply, the second power supply being connected to a return line also connected to said block.

6. A cooking appliance as claimed in claim 1, wherein the switch means are a static switch such as a TRIAC.

7. A cooking appliance as claimed in claim 1, wherein the transformers are provided with a protection fuse in the primary winding to interrupt power supply to the transformers if the timer means or switch means become locked in a position in which they continuously power said transformers.

* * * * *